US007347023B2

(12) United States Patent
Wössner et al.

(10) Patent No.: US 7,347,023 B2
(45) Date of Patent: Mar. 25, 2008

(54) MACHINE GUNS HAVING DETACHABLE BARRELS AND METHODS OPERATING THE SAME

(75) Inventors: Ernst Wössner, Sulz-Holzhausen (DE); Heinz Matt, Oberndorf (DE)

(73) Assignee: Heckler & Koch, GmbH, Oberndorf/Neckar (DE)

( * ) Notice: Subject to any disclaimer, the term of this patent is extended or adjusted under 35 U.S.C. 154(b) by 0 days.

(21) Appl. No.: 11/496,535

(22) Filed: Jul. 31, 2006

(65) Prior Publication Data

US 2007/0028500 A1 Feb. 8, 2007

Related U.S. Application Data

(63) Continuation of application No. 11/027,935, filed on Jan. 3, 2005, now Pat. No. 7,137,219, which is a continuation of application No. PCT/EP03/05926, filed on Jun. 5, 2003.

(30) Foreign Application Priority Data

Jul. 3, 2002 (DE) ..... 102 29 847

(51) Int. Cl.
*F41A 21/48* (2006.01)

(52) U.S. Cl. ..... 42/75.02

(58) Field of Classification Search ..... 42/75.02
See application file for complete search history.

(56) References Cited

U.S. PATENT DOCUMENTS 318,001 A * 5/1885 Kirkwood ..... 42/75.02
1,549,051 A * 8/1925 Schreiber ..... 89/192
2,061,313 A * 11/1936 Moore ..... 42/75.02
2,115,861 A * 5/1938 Laloux ..... 42/75.02
2,121,171 A * 6/1938 Laloux ..... 42/75.02
2,131,716 A * 9/1938 Browning ..... 42/75.02
2,136,512 A 11/1938 Laloux
2,362,613 A * 11/1944 Browning ..... 42/75.02
2,369,052 A * 2/1945 Ironside ..... 89/1.42
2,423,854 A * 7/1947 Simpson ..... 42/75.02

(Continued)

FOREIGN PATENT DOCUMENTS

CH 116607 9/1926

(Continued)

OTHER PUBLICATIONS

*International Search Report* for international patent application serial No. PCT/EP2003/05926.

(Continued)

*Primary Examiner*—Troy Chambers
(74) *Attorney, Agent, or Firm*—Hanley, Flight & Zimmerman, LLC

(57) ABSTRACT

Machine guns having detachable barrels and methods of operating the same are disclosed. An illustrated example firearm includes a housing; a removable barrel; a latch to releasably secure the barrel in the housing, the latch having a released state and a secured state; and a carrying handle movable between a rest position and a carry position. The carrying handle cooperates with the latch such that the latch can only be moved into the released state to permit removal of the barrel when the carrying handle is at least substantially in the carry position.

6 Claims, 4 Drawing Sheets

U.S. PATENT DOCUMENTS

| | | | | |
|---|---|---|---|---|
| 2,597,031 | A * | 5/1952 | Posey | 89/1.35 |
| 2,981,154 | A * | 4/1961 | Sweeney | 89/14.5 |
| 3,075,314 | A | 1/1963 | Bakker | |
| 3,198,076 | A * | 8/1965 | Stoner | 89/128 |
| 3,630,119 | A * | 12/1971 | Perrine | 89/189 |
| 3,791,256 | A * | 2/1974 | Curtis et al. | 89/185 |
| 4,388,773 | A * | 6/1983 | Beretta | 42/75.02 |
| 4,651,455 | A * | 3/1987 | Geiser, Jr. | 42/18 |
| 5,020,260 | A * | 6/1991 | Houghton | 42/75.02 |
| 5,155,284 | A * | 10/1992 | Flashkes | 42/75.02 |
| 6,418,655 | B1 * | 7/2002 | Kay | 42/75.02 |
| 6,470,617 | B1 * | 10/2002 | Gregory et al. | 42/75.04 |
| 6,694,660 | B1 | 2/2004 | Davies | |
| 6,889,463 | B2 * | 5/2005 | Orth | 42/75.03 |
| 6,907,687 | B2 * | 6/2005 | Rousseau et al. | 42/75.02 |
| 2005/0183319 | A1 * | 8/2005 | Franks | 42/94 |

FOREIGN PATENT DOCUMENTS

| | | |
|---|---|---|
| DE | 637298 | 10/1936 |
| DE | 678065 | 7/1939 |
| GB | 383754 | 11/1932 |
| IT | 0300180 | 11/1936 |
| WO | WO 2004005837 A1 * | 1/2004 |

OTHER PUBLICATIONS

English translation of the *International Preliminary Examination Report* for international patent application serial No. PCT/EP2003/05926.

German-language *International Preliminary Examination Report* for international patent application serial No. PCT/EP2003/05926.

* cited by examiner

MACHINE GUNS HAVING DETACHABLE BARRELS AND METHODS OPERATING THE SAME

RELATED APPLICATION

This patent is a continuation of U.S. patent application Ser. No. 11/027,935, which was filed on Jan. 3, 2005 now U.S. Pat. No. 7,137,219, which is a continuation of International Patent Application Serial No. PCT/EP2003/005926, which was filed on Jun. 5, 2003, the disclosures of both parent applications are incorporated herein by reference.

FIELD OF THE DISCLOSURE

This disclosure related generally to firearms, and, more particularly to, machine guns having detachable barrels, a latch to facilitate the attachment and removal of a barrel, and a foldable carrying handle mounted near the latch.

BACKGROUND

Positional terms such as "rear" or "top", "right" or "left" are used in this patent with reference to a weapon positioned in a shooting position, That is, with reference to a weapon positioned to shoot "forward" (i.e., away from the shooter), in a generally horizontal plane.

Conventional light weight machine guns often have a carrying handle that is mounted near the rear end of the barrel, (i.e., in proximity to the gun's center of gravity). The handle can be moved between a rest position and a working position. In the rest position, the carrying handle is folded down and rests against the jacket of the machine gun. In its working position, the carrying handle protrudes upwards from the machine gun and is positioned to serve for transporting the gun.

In general, such machine guns should be as light as possible and be able to handle long rounds and a high overall number of shots. Each shot fired produces heat and the gun barrel may become over-heated during use. To address this issue, these machine guns usually have devices that allow one to quickly exchange one barrel for another.

Such devices are usually designed as latches that snap into place. After the latch is opened, the barrel can be removed, for example, with asbestos-clad gloves or by means of a heat-insulated manual handle (see CH 116,607). Subsequently, a new barrel is inserted, and the latch is closed again. In its closed position, the latch should be firmly locked and hold the barrel in its proper position during the next round of firing.

There are several disadvantages with the above described prior art design. First, if the asbestos-clad gloves are not within easy reach or if there is a failure, the machine gun operator may inadvertently use his free hand to remove the hot barrel and injure himself. Second, in the excitement of a fight, it is easy to forget about the need to always carefully check and make sure that the latch is properly locked. If the latch is not properly locked, it could unexpectedly open, thereby permitting the barrel to fall out of the gun. One could conceive of a separate safety catch that would only allow the gun to fire when the latch has properly snapped into place. However, such a safety catch would disable the weapon if the barrel becomes loose and, at any rate, would be very complicated and, thus prone to failure.

It would also be possible to equip the snap-in latch with a secondary latch. However, such a secondary latch would require additional operations to exchange a barrel and, thus, delay and complicate the exchange process.

Detachable barrels on machine guns with carrying handles are known in the prior art. For example, U.S. Pat. No. 2,131,716 illustrates a device for removal and/or insertion of a barrel that can be provided in addition to a carrying handle on a machine gun. However, the actuation of the device shown in U.S. Pat. No. 2,131,716 is independent from the position of the carrying handle and/or can only occur when the carrying handle is in position B (see FIG. 2 of U.S. Pat. No. 2,131,716).

A transversally arranged eccentric rod used to hold a barrel of an automatic firearm in a detachable connection is known from U.S. Pat. No. 2,423,854.

DETAILED DESCRIPTION

Figure 1:
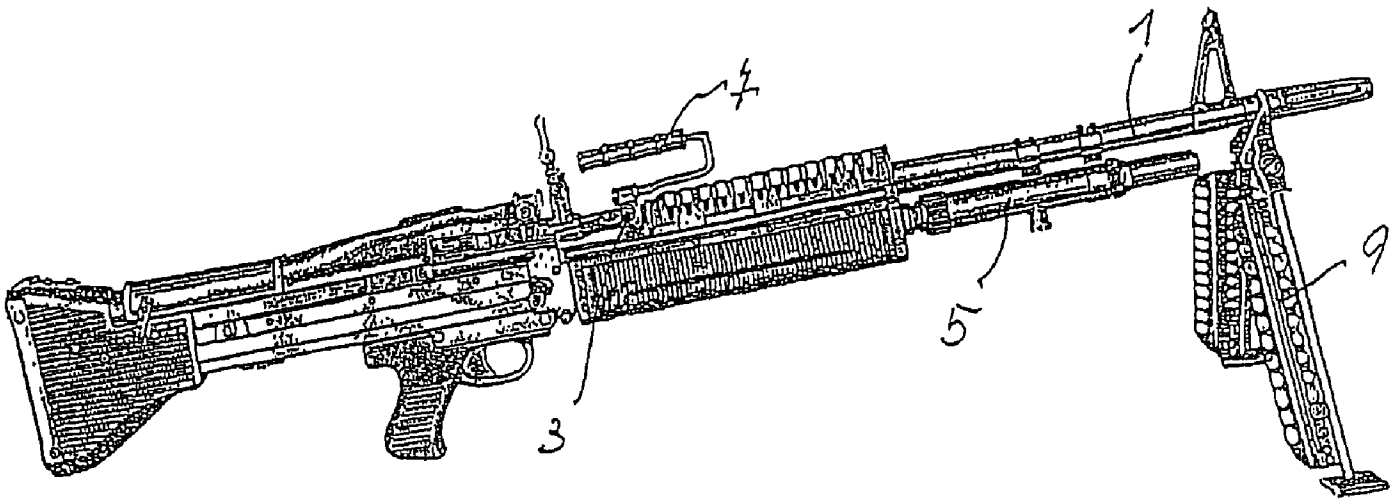
FIG. 1 is a side view of an example universal machine gun equipped with an example barrel exchange latch mechanism.

FIG. 1 illustrates an example machine gun (e.g., a US M60), which is equipped with an example barrel exchange latch mechanism 3 and an exchangeable barrel 1. Other than the inclusion of the barrel exchange mechanism 3, the remainder of the illustrated machine gun is largely conventional. Those portions of the weapon not described in the following are well known to persons of ordinary skill in the art.

To enable the removal of the barrel 1, the weapon of FIG. 1 is further provided with a removable gas piston device 5. The gas piston device 5 is typically removed to exchange the barrel 1 for a new barrel (which, although not separately shown, is identical to the barrel shown in FIG. 1) when the barrel 1 become hot from use.

The machine gun of FIG. 1 also includes a carrying handle 7. The carrying handle 7 is mounted on the machine gun such that it can be folded between a rest position and a carrying position. FIG. 1 illustrates the handle 7 in an example carrying position. In this position, the carrying handle 7 may obstruct the line of sight. In such an example, the handle 7 should be folded down to the rest position before shooting.

When removing a hot barrel 1, the user actuates the barrel-exchange latch mechanism 3, grabs the barrel 1 with an insulated glove, (e.g., an asbestos-clad glove), and pulls the barrel 1, along with the bipod 9, forward in the direction of firing. In this process, the gas piston device 5 is separated into two parts, with one part remaining on barrel 1 and the other part remaining on the machine gun.

Figure 2:
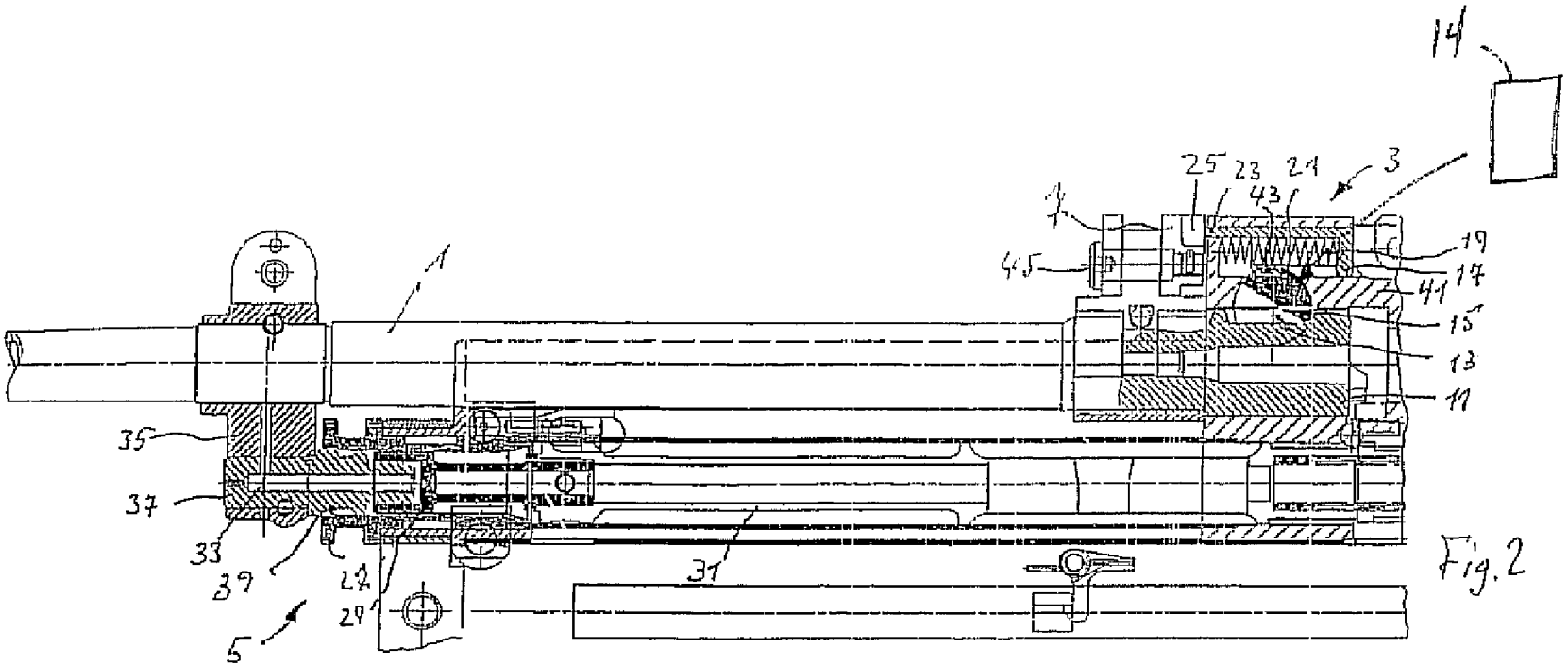
FIG. 2 is a longitudinal cross-sectional view of the example barrel exchange latch mechanism shown in its ready-to-shoot state in which a barrel exchange is precluded, with portions shown in block diagram form.

FIG. 2 is a cross-sectional view of the example barrel-exchange latch mechanism 3 of FIG. 1. Note that in FIG. 1 the machine gun points to the right, while in FIGS. 2 and 3, the machine gun points to the left.

As shown in FIG. 2, the exchangeable barrel 1 of the illustrated weapon comprises an expanded rear end 11. The rear end 11 is in communication with the magazine and is inserted into the front of a fitting borehole in the jacket/housing 41 of the machine gun.

The upper part of the rear end 11 includes a recess 13. A transversally extending eccentric bar 15 is mounted in the gun jacket 41 near the recess 13. The eccentric bar 15 is rotatable. In the position illustrated in FIG. 2, the rear part of the eccentric bar 15 protrudes into the recess 13 of the barrel 1. This engagement between the eccentric bar 15 and the barrel 1 prevents the barrel from moving forward, (i.e., blocks the barrel from being removed). Thus, when the eccentric bar 15 is in the position of FIG. 2, the weapon is in a ready-to-shoot position.

Figure 3:
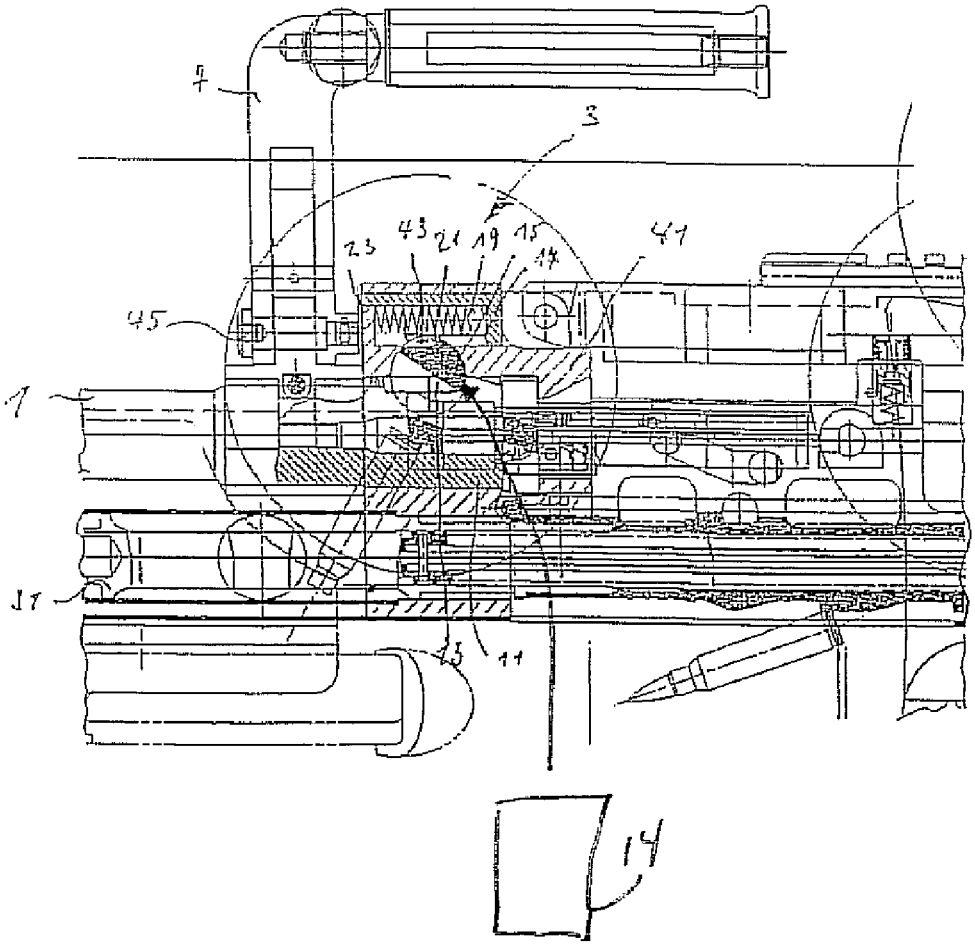
FIG. 3 is a longitudinal cross-sectional view of the example barrel exchange mechanism of FIG. 2, but shown in its release position in which a barrel exchange is permissible, with portions shown in block diagram form.

A handling device 14 (e.g., a lever) is located on the end of the eccentric bar 15 and shown in FIGS. 2 and 3 in block diagram form.

A slider 17 is located within a cavity defined in the housing 41 above the eccentric bar 15. The slider 17 is longitudinally movable and is pushed to the back by a spring 19. The slider 17 includes a slider block 43 on the bottom and a slider lug 23, which extends the slider 17 towards the front. The slider lug 23 can emerge from the housing/jacket 41. In the illustrated example, the slider lug 23 is formed in one piece with the slider block 43. A transversally extending recess 21, which opens forward, is disposed in the upper side of the eccentric bar 15.

In the position shown in FIG. 2, the slider block 43 sits in the recess 21. The slider block 43, which forms a part of the slider 17, interacts with the recess 21 of the eccentric bar 15 to substantially prevent the eccentric bar 15 from turning clockwise beyond the position shown in FIGS. 2 and 3. When the slider lug 23 and, thus, the slider block 43, are moved sufficiently forward against the force of the spring 19 (i.e., by pivoting the eccentric bar 15 with the handling device 14), the eccentric bar 15 turns counter-clockwise from the position shown in FIG. 2 and exits the recess 13. As a result, the barrel 1 can be pulled out of the housing 41 toward the front of the weapon. If the handling device 14 connected with the eccentric bar 15 is subsequently released, the eccentric rod 15 and the slider block 43 return to the position shown in FIGS. 2 and 3 under the influence of the spring 19. A new barrel may then be pressed from the front into the borehole in the jacket 41.

When a new barrel is so inserted, it rotates the eccentric bar 15 counter-clockwise against the force of the spring 19. When the new barrel is sufficiently inserted, the eccentric bar 15 snaps back into the position shown in FIG. 2. When the eccentric bar 15 snaps back into the position of FIG. 2, the slider lug 23 re-enters the jacket 41, and the barrel 1 is completely fit into the borehole. A sloping edge/camming surface on the top of the rear end 11 of the barrel 1 facilitates this snap-in procedure.

Further toward the front, the barrel 1 has a gas borehole (not shown) that extends radially from the bottom and connects to a gas channel 33 located within a gas discharge element 35. An axial gas discharge element 37 is attached in a well known fashion to the open end of the radial gas discharge element 35. The angular gas channel 33 continues to the rear in this gas discharge element 37. The gas discharge channel 33 ends in a plug-in block 39 which is structured as a piston. This plug-in block 39 is detachably inserted from the front into a gas cylinder 27. The gas cylinder 27 includes a movable gas piston 29. This piston 29 transfers its backward movement to a rod assembly 31 which, in turn, transfers its movement to a closure mechanism (not numbered) to initiate unlocking of the bolt head of the breech. The bolt head and breech mechanism are partially shown in FIG. 3. For more details of this structure, the interested reader is referred to U.S. patent application Ser. No. 11/027,934, which is being concurrently filed herewith and which is hereby incorporated by reference in its entirety.

To release the eccentric bar 15 from the recess 13 in the rear end 11 of the barrel 1, the lever 14 coupled to the eccentric bar 15 is used to rotate the eccentric bar 15 counter-clockwise. After the eccentric bar 15 exits the recess 13, the barrel 1 can be pulled forward and out of the machine gun. Concurrently, the plug-in block 39 of the gas piston device 5 is pulled out of the gas cylinder 27. The illustrated gas cylinder 27 may be implemented as an expendable part that can be exchanged at any time.

As shown in FIG. 2, a horizontal axle 45 is attached to the housing/jacket 41 just in front of, and beneath, the slider 17. The axle 45 is the support pivot for the carrying handle 7. Attached to the bottom of the carrying handle 7 is a stop block 25. The stop block 25 faces the slider 17, and lies directly in front of the slider lug 23 when the carrying handle 7 is folded down in the ready-to-shoot state as shown in FIG. 2. When the stop block 25 is in this position, it prevents the slider lug 23 from exiting the jacket 41 and, thus, prevents the slider 17 from moving forward. The handle 7 may be structured with a snap-in connection, wherein the slider lug 23 fixes the carrying handle 7 in its ready-to-shoot position by a spring-biased engagement in a recess in the stop block 25.

When the carrying handle 7 is rotated up to the position shown in FIG. 3 (e.g., for transporting the weapon as the shooter changes his/her position), the stop block 25 swivels past the slider lug 23 and releases it for forward longitudinal movement. (The stop block 25 is not visible in FIG. 3 because it lies before the plane of the drawing.) The barrel 1 can only be exchanged when the carrying handle 7 is in this position (i.e., the position of FIGS. 1 and 3). In the ready-to-shoot position shown in FIG. 2, the barrel 1 may not be exchanged because the eccentric bar 15 may not be turned out of the recess 11 because it rests, through the slider 17 and the slider lug 23, against the stop block 25 of the carrying handle 7. The eccentric bar 15 can only be turned when the stop block 25 is not located in front of the slider 17 and the slider lug 23 is, thus, free to move forward (i.e., when the handle 7 is in the position shown in FIG. 3). This approach provides added security because the barrel 1 may only be exchanged when the carry handle 7 is rotated up, into a position obstructing the gun operator's view (i.e., where the weapon is not in a ready-to-shoot fire state).

Figure 4:
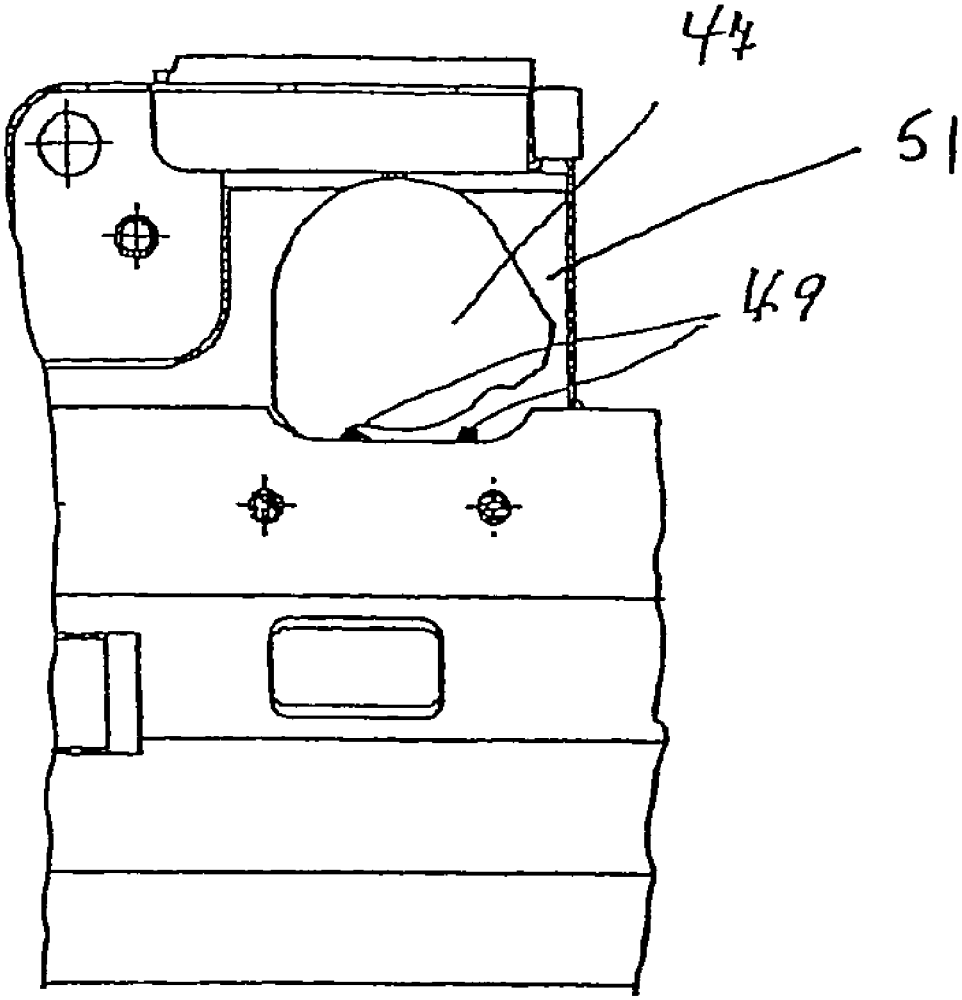
FIG. 4 is an enlarged view of the check plate that rests on the end of the eccentric bar in the example barrel exchange mechanism of FIGS. 1-3.

FIG. 4 is an enlarged top view of the end of the eccentric bar 15. This top view is from the right side of the machine gun; thus, in this drawing, the direction of shooting is to the right.

To limit the range through which eccentric bar 15 can turn, a check plate 47 is mounted in a recess 51 in the jacket 41. This check plate 47 is sized to allow the eccentric bar 15 to turn only between its two end positions in the shortest path and prevents the eccentric bar 15 from turning beyond these end positions.

The check plate 47 is associated with two snap-in devices 49 in the recess 51 of the jacket 41. These snap-in devices 49 may be implemented by, for example, spring-mounted snap-in balls. The snap-in devices 49 stop the check plate 47 and, thus, limit the rotation of the eccentric bar 15 in each of its two end positions.

From the foregoing, persons of ordinary skill in the art will appreciate that the illustrated example machine gun has a barrel 1 which can be exchanged as quickly as in conventional firearms, but in a safer and more reliable fashion. To this end, the illustrated example device 3 that permits exchanging of the barrel 1 can only be brought into the release position when the carrying handle 7 is in the carrying position. Furthermore, the illustrated device 3 is simpler, or at least not more complex, than what is known in the art.

In the illustrated example, the eccentric bar 15 cannot extend beyond its end positions or, at least, cannot exceed them substantially. A person of ordinary skill in the art will appreciate that the illustrated example uses a locking piece 25 to prevent the eccentric bar 15 and the carrying handle 7 from unexpectedly moving from one end position towards the other. This locking piece 25 stops the eccentric bar 15 and the carrying handle 7 in an end position. The eccentric bar 15 and the carrying handle 7 can be moved beyond the stopped position through the exertion of additional force. This not only ensures the usability of the machine gun both in the rest and in the ready-to-shoot position, but it also avoids any situation where the eccentric bar 15 is wrongly turned with the barrel 1 removed so that a new barrel 1 cannot be simply inserted.

While the mechanism in the illustrated example prevents the end positions of the eccentric bar 15 from being exceeded, it does not prevent the possibility of the eccentric bar 15 being heavily stressed during a rush operation and possibly damaged as a result. Therefore, the illustrated example utilizes a check plate 47 on the eccentric bar 15 in order to absorb such stress in the end position and, thus, relieve the mechanism of that stress and the potential for damage.

A person of ordinary skill in the art will appreciate that the carrying handle 7 of the illustrated example is also used as a safety device. In particular, the illustrated carrying handle 7 guarantees that the machine gun can only shoot when the inserted barrel 1 is fully locked in place. When the carrying handle 7 is in its ready/carry position, it is not possible to aim the machine gun since the carrying handle 7 is directly in the gun operator's field of view and, therefore, it is difficult to shoot. This decreases the likelihood of a shot being fired from a misassembled weapon.

A person of ordinary skill in the art will further appreciate that the illustrated example helps the gun operator avoid injury during the changing of a hot barrel 1. During the exchange of the barrel 1, the gun operator usually has one hand on the carrying handle 7. In order to exchange the barrel 1, the operator grabs the hot barrel 1 at a heat-insulated handle or using some protective gear, (e.g., an asbestos-clad glove), while his other hand holds the carrying handle 7. As a result, the temptation to assist with the other hand—and injure it, while doing so—is reduced.

In a further example, the machine gun has a carrying handle 7 that can only be brought into its rest position when the device 3 that releasably secures the barrel 1 is in its ready position. However, it is preferred that, during the transfer of the carrying handle 7 from its position of use (i.e., the carry position) to its rest position, the device 3 that releasably secures the barrel 1 is pressed into its ready position. As a result should the aforementioned device 3 become stiff to operate, (e.g., due to some dirt), it can still be brought into its locked position by means of the carrying handle 7 without facing the risk that the barrel 1 is not properly locked in.

In a preferred example, a weapon jacket/housing 41 defines a longitudinal borehole that receives the rear end 11 of the barrel 1. The rear end 11 of the barrel 1 has a transversally extending recess 13. Also, the weapon jacket 41 carries a transversally running eccentric bar 15 that can turn to—with the barrel 1 inserted—engage or disengage in the recess 13. The carrying handle 7 is operatively coupled with the eccentric bar 15 when the eccentric bar 15 is engaged with the recess 13, but is uncoupled from the eccentric bar 15 when the eccentric bar 15 is disengaged from the recess 13.

An operation lever 14 is mounted on the eccentric bar 15, and may be used to turn the eccentric bar 15. The lever 14 must be long enough to ensure that the unlocking of the device 3 that releasably secures the barrel 1 is easily possible, even after an accumulation of dirt and rust. Furthermore, the recess 13 can be fabricated in a simple and inexpensive fashion so that the costs related to an exchangeable barrel 1 are minimized. Should the exchangeable barrel 1 be dirty, the recess 13 can be wiped off, without any extraordinary effort, by hand or with a piece of rag.

In the illustrated example, a slider 17 is pressed into engagement with the eccentric bar 15 by a spring 19. The slider 17 can be pushed back away from the eccentric bar 15 when the carrying handle 7 is in its use/carry position. However, when the carrying handle 7 is in the rest position, it blocks the slider 17 from being pushed back. Thus, due to the slider 17, the eccentric bar 15 is automatically blocked and cannot be released as long as the carrying handle 7 is in its rest position. Therefore, the gun operator can always be sure that the barrel 1 of his machine gun is secured in its proper place by observing the position of the carrying handle 7.

A person of ordinary skill in the art will appreciate that the illustrated example latch can be used, for example, in a delayed recoil repeater gun, whose breech block is locked in the manner of the Swiss assault rifle 57 or the German G3. Furthermore, it is particularly advantageous to use the latch with gas-pressure repeater guns because, during the exchange of the barrel 1, the connection between the barrel 1 and the gas channel 33 must also be separated, which is easy to do because the barrel 1 is inserted into its retaining borehole from the front in the direction of the centerline of the borehole.

A person of ordinary skill in the art will further appreciate that it is especially advantageous for an extension to be mounted on the barrel 1 between its muzzle and its rear end 11. In the illustrated example, the extension comprises a gas borehole in communication with the barrel 1. The gas borehole includes a free end that is offset backwards, and which extends parallel to the barrel 1 and ends in a plug-in block 39. Furthermore, it is advantageous if the machine gun includes a gas channel 33 that is open in the forward direction and that, with the barrel 1 inserted, can be closed by the plug-in block 39. The plug-in block 39 may only loosely be inserted into the gas channel 33. However, it is also possible, and under certain circumstances advantageous, to equip the plug-in block 39 with sealing rings and insert it into the gas channel 33 so that it seals it off, especially in the case of small or weak cartridges, in which the developed gas quantity is relatively small.

Although certain example methods, apparatus and articles of manufacture have been described herein, this patent covers all methods, apparatus and articles of manufacture fairly falling within the scope of the appended claims either literally or under the doctrine of equivalents.

What is claimed is:

1. A firearm comprising:

a housing;

a removable barrel;

a latch to releasably secure the barrel in the housing, the latch having a released state and a secured state; and a carrying handle mounted directly to the housing and movable between a rest position and a carry position, the carrying handle cooperating with the latch such that the latch retains the removable barrel within the housing when the carrying handle is in the carry position, and wherein moving the carrying handle from the carry position to the rest position forces the latch into the secured state.

2. A firearm comprising:

a housing;

a removable barrel;

a carrying handle mounted directly to the housing and movable between a rest position and a carry position; and a latch to releasably secure the barrel in the housing, the latch having a released state and a secured state, wherein the latch may be selectively moved between the released state and the secured state when the carrying handle is in the carrying position.

3. A firearm as defined in claim 2, wherein the latch secures the barrel in the housing when the carrying handle is in the rest position.

4. A firearm as defined in claim 2, wherein the latch secures barrel in the housing when the carrying handle is in the carrying position.

5. A firearm as defined in claim 2, wherein the carrying handle may be locked in either the carrying position or the rest position when the barrel is attached.

6. A firearm as defined in claim 2, wherein the carrying handle may be locked in either the carrying position or the rest position when the barrel is detached.

* * * * *